US008827582B1

(12) United States Patent
Seymour et al.

(10) Patent No.: US 8,827,582 B1
(45) Date of Patent: Sep. 9, 2014

(54) LIP GLOSS APPLICATOR

(75) Inventors: Phillip Seymour, New York, NY (US); Benjamin Martin, Brooklyn, NY (US)

(73) Assignee: Lipsinc LLC, New York, NY (US)

( * ) Notice: Subject to any disclaimer, the term of this patent is extended or adjusted under 35 U.S.C. 154(b) by 399 days.

(21) Appl. No.: 13/350,269

(22) Filed: Jan. 13, 2012

Related U.S. Application Data

(60) Provisional application No. 61/432,543, filed on Jan. 13, 2011.

(51) Int. Cl.
*A46B 11/00* (2006.01)

(52) U.S. Cl.
USPC ..... 401/10; 401/6; 401/9; 401/263; 401/265

(58) Field of Classification Search
USPC ..... 401/6, 9–12, 261–266, 171–180; 132/317, 320
See application file for complete search history.

(56) References Cited

U.S. PATENT DOCUMENTS

| | | | | |
|---|---|---|---|---|
| 2,328,973 | A * | 9/1943 | Goldfisher | 401/11 |
| 2,784,721 | A * | 3/1957 | Davis | 132/320 |
| 3,088,470 | A * | 5/1963 | Hall | 401/11 |
| 3,938,706 | A * | 2/1976 | Cohen | 222/83.5 |
| 7,841,793 | B2 * | 11/2010 | Ramet | 401/11 |

* cited by examiner

*Primary Examiner* — David Walczak
(74) *Attorney, Agent, or Firm* — Andrew S. Langsam; Pryor Cashman LLP

(57) ABSTRACT

A lip gloss dispenser/applicator which uses the impression of an individual's lips as the applicator surface. The dispenser container contains a soft, plastic mold of a set of lips, realistic in look and texture, which a user can "kiss" to apply the gloss. The gloss is contained within a reservoir beneath, and sealed around, the artificial and molded lips. The gloss is applied from the reservoir by a turning knob-like mechanism beneath the container, which controls an elevator-type lift inside the container. As the mechanism turns, the lift rises, pressing the reservoir against the bottom of the lips, forcing small amounts of gloss through a hole and onto the front of the lips. Micro-fissures in the lips evenly spread the gloss.

11 Claims, 4 Drawing Sheets

LIP GLOSS APPLICATOR

RELATED APPLICATIONS

This application claims priority upon U.S. provisional patent application No. 61/432,543, filed on Jan. 13, 2011, and entitled "LipsInc's Celebrity Lips," the entirety of all of which is hereby incorporated by reference.

FIELD OF THE INVENTION

The present invention relates to a cosmetic dispenser and applicator device which stores lip gloss and/or lip balm or a medicated, candy or other lip-specific liquid, gel or substance for application to the lips of an individual. The applicator allows for the easy, effective, and entertaining (especially for a tween-aged boy or girl and/or a teenager, for example) application of such onto the lips of a user. The invention comprises a compressible bladder with the lip-related gloss or balm (gel, liquid, thin-film solid, candy-flavored medication, candy, etc., hereinafter collectively referred to as the "lip gloss") contained therein. The bladder is held in a dispenser which, as desired, compresses the bladder to release the lip gloss. An opening is connected to one part of the bladder and directs the compressed lip gloss through an aperture located through and integral with a shaped and molded real pair of human lips. Preferably the human lips correspond to the actual lips (taken by impression casting) of a celebrity. A user can thus apply the lip gloss by mechanically compressing the bladder, forcing the lip gloss to pass through the tube connecting the same to the opening in the lip applicator surface and thus, by the user "kissing" the lip surface of the applicator device, the lip gloss will be spread onto his/her own lips with effectiveness, with entertainment and psychologically value and in an easy and simple manner.

BACKGROUND OF THE INVENTION AND DISCLOSURE

The present invention relates to a lip gloss dispenser and applicator, primarily intended for tween or teenage girls, who purchase huge quantities and varieties of cosmetic products, including lip-related products. These high relative spending consumers are also the demographic category primarily interested in certain tween and teen idols or celebrities. For a teen or tween to apply a lip gloss related product, a highly desired application to her lips, and to do so easily, effectively and with emotional attachment (in effect the young girl is applying the lip gloss by "kissing" the lips of a movie star, television star, rock star, etc.) is a highly desired goal. If the lip gloss contains needed medication, this is one manner of presenting the applicator in a way which makes the "taking" of medicine highly tolerable, i.e., by kissing the lips of one to which the user has an emotional attachment. The actual lip gloss applicator's application surface is a simulation and/or an actual casting or mold of a celebrities or tween/teen idol's lips.

This invention will give these teenagers the appeal of kissing, while also allowing them to keep up with common fashion trends of applying lip gloss. If the lip gloss is a medication which can be administered orally by topical application to the lips, the present invention is highly effective to ensure application by the patient. Unlike an ordinary lip gloss container, the present invention comprises the use of an applicator, on one end of the container, shaped like a pair of actual lips. The shape of the set of lips will desirably be molded to resemble an actual human pair of lips, and more preferably, that of a tween/teen or other celebrity. Therefore, a user will not only get the function of applying a lip gloss, but also the sensation of "kissing" the lips of a teen/tween idol or celebrity.

The invention comprises a small container for holding the lip gloss within a collapsible bladder-like or envelope mechanism. The applicator end of the container which will come into contact with the user is a rubber or at least resilient (to simulate real lips, thus not hard and inflexible plastic) molded set of lips, textured and with look and resilient feel to resemble an actual set of lips. On the mechanical or other end of the container is a simple turning wheel or mechanism. This mechanism will move a plate upwardly when the turning wheel is rotated. That plate will cause the bladder, with lip gloss contained therein, to be squeezed out of the bladder, through a small tubing section, and into an aperture (corresponding to a small opening between the application lip surface) of the lips. The lip gloss will easily and conveniently spread over the surface of the lips and then the user can "kiss" the lips and transfer the lip gloss to her own lips. Preferably the lips of the device are provided with textured and very small channel passages which both serve to simulate real lips (which are not perfectly smooth) and to facilitate the spreading of the lip gloss to the surface of the applicator's lips.

The lip gloss or other material sought to be transferred from applicator and package to the lips of the user, is held, until use (and multiple usages are contemplated by a single bladder pre-filled with lip gloss) within the container. The reservoir resembles a small bladder or balloon which is pre-filled with the lip gloss and maintained therein until desirably used. The bladder is preferably located in close proximity to the bottom surface (which can be substantially flat) of the lip-shaped surfaces of the applicator, so that the lip gloss inside will not accidentally leak.

Beneath the reservoir, and also inside the container, is a movable elevator-lift planar surface, controlled by a simple knob and screw turning mechanism at the bottom of the container. As the knob is turned, the planar lift rides on the screw threads and the planar surface elevates towards the bottom end of the applicator's lip surface. The squeezing of the bladder between the planar surface of the lift and the bottom flat surface of the applicator's lip surface squeezed the lip gloss and causes a quantity to pass through a central hole of the applicator's lips. The small fissures of the applicator's lips and/or its surface configuration and the viscosity of the lip gloss cause the lip gloss exuded from the bladder to coat a significant surface area of the lips. The user can then press her lips on the applicator's lip surface and transfer the lip gloss to the user.

As the reservoir or bladder containing the lip gloss is constricted, some of the substance, proportional with the amount the lift is elevated (and thus proportional to the amount of rotation of the knob and movement of the planar surface up on the screw threads) and thus the force on the reservoir, is pushed through the small hole in the center of the surface of the applicator's lips. Accordingly, when the knob-like mechanism at the base of the container is rotated or turned, the planar lift rises and a small amount of lip gloss, the amount being directly proportional to the rotation by which the mechanism is turned, is pushed out of the bladder, through the hole of the lips and caused to be spread over the artificial surface, resembling lips of the applicator. A user can then "kiss" the lips of the container to apply or transfer the lip gloss to his or her own lips.

The artificial lip surface of the lip gloss applicator disclosed herein is slightly resilient, somewhat soft, and unlike a hard plastic surface. It is meant to simulate the firmness, look and feel of a human's lips. The artificial lips of this applicator are also desirably textured to resemble a human set of lips. In the primary embodiment, the lips are shaped to resemble those of a celebrity, giving the user the sense or illusion that they are embraced in a kiss with that celebrity while applying the lip gloss. The use of the present invention eliminates the necessity to use one's fingers to apply lip gloss to their lips and/or a cylindrical tube of lip gloss, even with a lip contouring surface, as provided by prior art lip gloss products. A user will manipulate the present invention to dispense the lip gloss through the hole in the artificial cast lips of the applicator and onto the surface thereof. The user will then apply or transfer the lip gloss by putting their lips in contact with the artificial cast lips of the applicator, thereby spreading and transferring the lip gloss by means of a "kiss."

The reservoir or bladder enclosed inside the container, which holds the lip gloss, is sealed and located immediately beneath the bottom end of the artificial lips thereby forming a collapsible and squeezable membrane filled with the lip gloss substance. The only opening from that bladder is a small aligned hole or a short tube extending to and through a hole located in the center of the artificial applicator surface of the lips. This configuration prevents the lip gloss from accidentally leaking when the applicator is not being used, and allows the user to substantially precisely control the amount of lip gloss dispensed when the mechanism which controls the lift is turned, by rotating the know which causes the planar lift surface to glide up on the threads of the screw, attached to the turning knob. Rotation of the turning knob rotates the threads of the threaded central post and since the lift is secured to the threads and bound within the oval-shaped wall of the applicator's body, the planar lift will move upwardly (or downwardly) depending upon the rotational direction of the knob. This then, causes the bladder with its contents to be squeezed between the planar surface of the lift and the flat bottom of the artificial lips of the applicator.

The cover to the container of the present invention can also be shaped like a pair of lips, and directly fits over the shaped lips of the applicator. This cover serves to protect the surface of the artificial lip gloss applicating lips but the top surface thereof is purely aesthetic, as it serves no function for the invention, other than to display to a viewer the shape of the lips inside and to protect the artificial lip surface and the lip gloss from exposure.

DESCRIPTION OF PRIOR ART

The dispensing of lip gloss from a container is certainly disclosed by prior art. This can be provided by a simple small and round tin which allows the user to put her finger therein, pick up a quantity of lip gloss and smooth the finger over the person's lips for transfer of the lip gloss to the lips. Alternatively, lip gloss applicators have taken the shape of conventional lipstick applicators, i.e., cylinders with a rotatable knob at one end which expose the end of the lipstick as the knob is turned (after removal of the cap). These lipsticks are generally of a slanted surface for ease of application to one's lips. Lip gloss is also provided by pencil-like applicators, too.

In addition, the use of a turning mechanism to project a gel, a solid, or a semi-solid substance from a small (often oval shaped) container is not new, as it is commonly used in deodorant dispensers. The new and patentable distinction of the present invention is the use of such an applicator in connection with lip gloss and providing the application surface within the applicator in the shape of and with the semblance of the physical attributes of human lips. The applicator surface is shaped and textured (and with some slight resilience to replicate the softness and resilience of human lips) so as to resemble the lips of a human, and preferably a celebrity. No one has used the shape, texture, resilience, etc. even the mold of a set of actual or replicated human lips as the application surface for a lip gloss product, by which the set of artificial lips are first coated with the lip gloss and the transfer of the lip gloss to the user is accomplished by touching the lips of the user to the artificial lips of the applicator's surface.

SUMMARY OF THE INVENTION

The present invention comprises a lip gloss dispenser and applicator which uses the impression of an individual's lips as the surface for transfer of the lip gloss to the user. One end of the dispenser provides a soft plastic, realistic feeling set of molded lips, which itself is used as the applicator of the gloss. Beneath the artificial lips is a planar lift surface. Between the bottom of the artificial lips and the top of the planar lift surface is a flexible, balloon like device, a bladder pre-filled with lip gloss. The bladder, like a two-sided mylar balloon before inflation, is preferably attached, by one side, to the relatively flat and bottom end of the set of artificial lips and on the other side of the bladder to the top of the flat planar lift surface. A hole in the bladder is fluidly connected to a hole in the artificial lips or by use of a small tube. The selected and controlled removal and dispensing of the lip gloss from the bladder/reservoir is accomplished by activating or rotating a knob-like turning mechanism on the bottom end of the container (the end opposite the set of artificial lips), which has a threaded central post attached thereto. Since the post has a threaded planar lift surface on the post and the lift surface is confined by the interior walls of the container, rotation of the knob causes the lift surface to move up or down on the threaded post. As the mechanism is turned, the lift rises up towards the artificial lips—the distal end of the container and squeezes or constricts the bladder or reservoir between the top of the planar lift and the bottom of the artificial lips. This forces a small amount of the lip gloss through the hole and onto the top surface of the artificial lips. The gloss is then spread onto the lips from the bladder or reservoir as a consequence of small fissures or channels on the surface of the artificial lips and/or the surface configuration of the lips. The lip gloss passes through the hole from the bladder through the hole of the lips and onto the surface of the lips. Then, a user can apply or transfer the gloss to his or her own lips by "kissing" the artificial lips of the applicator. In the preferred embodiment, the lips on the applicator are molded to resemble the lips of a celebrity. The effect will provide a user the illusion, and satisfaction, of "kissing" someone, and maybe even a celebrity, while applying the lip gloss. In the preferred embodiment the shape of the container for the lip gloss is like that of a small or travel size version of under arm deodorant. According to the preferred embodiment of the present invention, the cap of the applicator, i.e., the component which covers the artificial lips when the applicator is not in use is substantially similarly shaped as the same lips of the artificial lips used for lip gloss application.

As mentioned, the look and feel, the resilience, the fullness and compressiveness of the artificial lips is substantially that of and meant to replicate real human lips and not a hard incompressible plastic surface.

DETAILED DESCRIPTION OF THE DRAWINGS AND THE PREFERRED EMBODIMENT

Description will now be given of the invention with reference to the attached FIGS. 1-6*a* and 6*b*. It should be understood that these figures are exemplary in nature and in no way serve to limit the scope of the invention as the invention will be defined by claims, and the scope of the invention will be the scope of the claims, as interpreted by the Courts.

Figure 1:
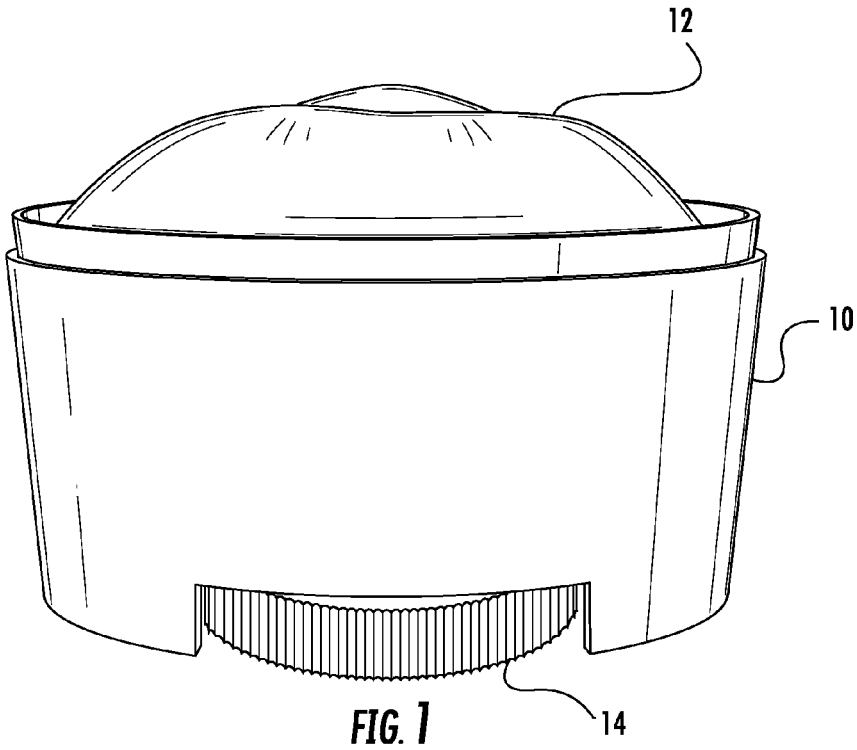
FIG. 1 is a front elevational view of the present invention with the cover removed.

FIG. 1 is a front view of the present invention, and specifically a lip gloss container and applicator 10. As can be seen, the container is a small oval in cross section shape. Located on the top of the container 10 is a pair of soft, realistic and preferably molded lips 12, shaped and textured, with fullness, resilience and compressibility, so as to resemble a pair of real human lips. According to the preferred embodiment of the present invention, the lips 12 are actually molded from a real pair of human lips, even more preferably, for commercialization purposes, from the lips of a celebrity. There is a resilience and feel to the lips so as to realistically simulate the feel of real lips, i.e., in the preferred embodiment the lips are not hard plastic but have a rubbery texture. The bottom of the container 10 is provided with a turning mechanism 14 in the shape of a small disc like element, preferably knurled, to facilitate selective clockwise and counterclockwise turning with respect to a vertical axis passing down through the center of the container. The turning mechanism 14 or knob is provided with a fixed vertical and threaded post. Located and threaded over the post (similar in construction to that of an underarm deodorant stick) is a planar lift surface (see FIG. 5). Rotation of the knob 14 rotates the post and since the planar lift surface is secured around the post by mating threads and the planar lift surface is confined by the inside oval wall of the container (i.e., the flat planar lift can not rotate but, rather, will only move up and down as the knob is rotated and the post correspondingly rotated) causes the planar lift surface to raise or fall with respect to the bottom of the container. This turning mechanism selectively controls the internal planar lift inside the container 10, and that controls the squeezing of lip gloss onto the artificial lips 12 of the applicator.

Figure 2:
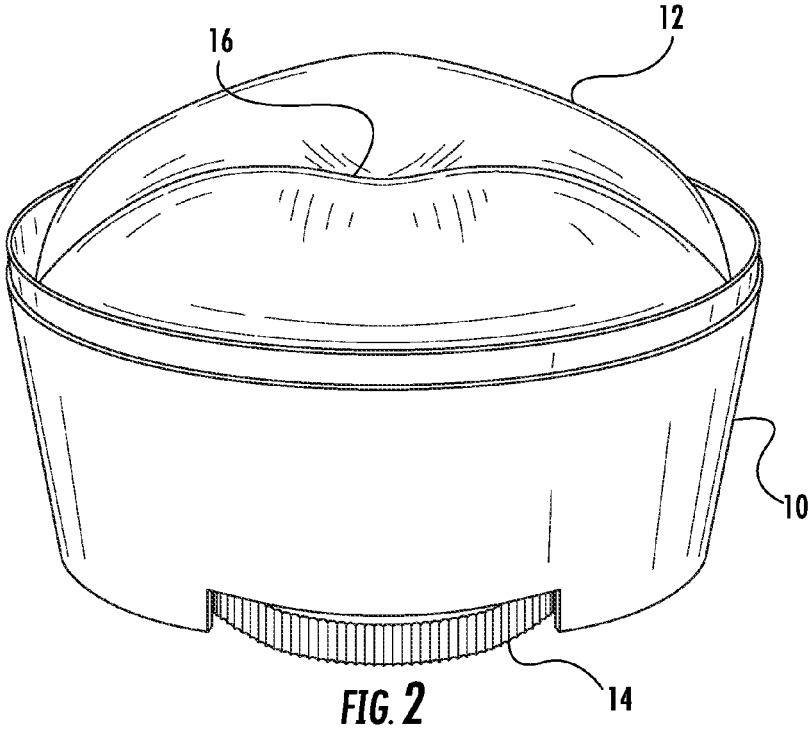
FIG. 2 is a front perspective view of the present invention.

FIG. 2 is a top and front perspective view of the present invention, showing substantially the same elements as FIG. 1. Again, one can see the artificial yet realistic in look and feel lips 12 at the top of the container. Beneath the lips is the flat planar lift, held on a vertical threaded and centrally located post which is secured to yet rotatable with the rotatable knob 14 at the bottom of the container.

Figure 3:
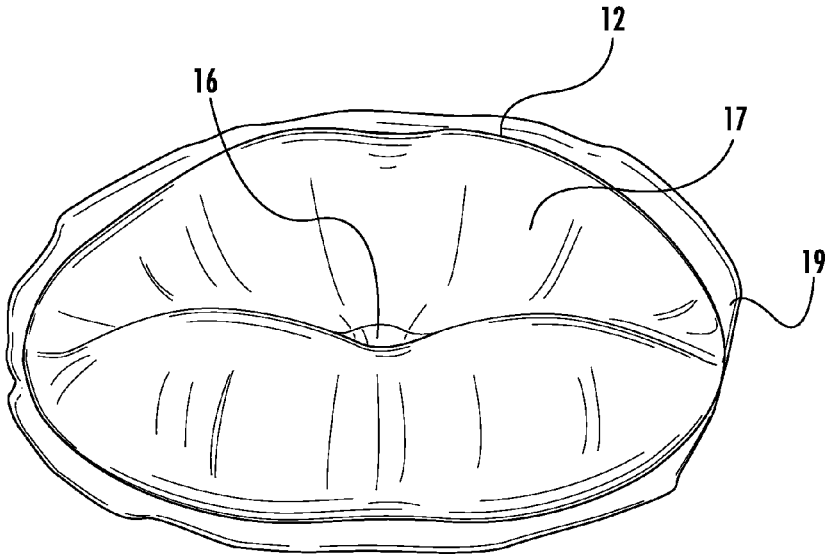
FIG. 3 is a top plan view of the pair of artificial lips comprising the applicator surface of the lip gloss for a user.
Figure 4:
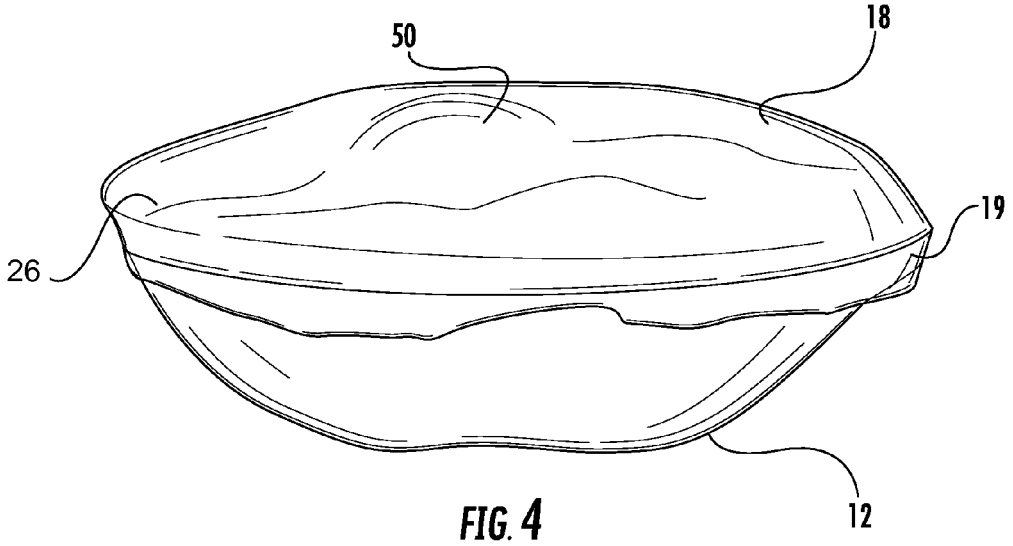
FIG. 4 is a side and upside down view of the pair of artificial lips and the bladder reservoir which serves to hold the lip gloss before it is dispensed.

FIG. 3 is a top view of the artificial lips 12 of the present invention and shows the set of lips 12 with a central opening 16 passing therethrough, i.e., from bottom of lips to the center of the pursed lips. In this embodiment (see FIGS. 3 and 4) one can see that a thin, plastic sheet secured to the perimeter of the lips 12. The bottom surface 26 of the lips 12, substantially flat (see FIG. 4) and the thin plastic sheet 18 define therebetween a small envelope or holding cavity for lip gloss. The edge 19 of the plastic sheet is heat sealed or adhered to the perimeter of the molded lips 12. Thus, the back or bottom surface 26, a relatively flat surface of the artificial lips, and the inside surface of the plastic sheet 18 in effect are a compressible bladder for the lip gloss. A hole 16 (See FIG. 3) is formed in the center of the artificial lips such that when the cavity or container (or pouch) with lip gloss therein is compressed, the lip gloss will necessarily exude and only pass from the interior of the bladder or cavity/pouch through the hole 16 and onto the front surface of the lips 12.

As can be seen in FIGS. 1, 2 and 3, the lips 12 are realistic looking and in feel and texture, too. Preferably they are not made of smooth and hard plastic but, rather, are made from a cushy or resilient and realistic or rubbery material so that when the user puts her lips against and on the artificial lips (for transfer of the lip gloss) the feeling is quite realistic and feels like one person kissing another on the lips. The surface of the lips 12 are preferably provided with one or more micro fissures or fluid-carrying channels 17, providing texture much like real lips, but also serving to channel and spread the lip gloss from the hole 16 onto a not-insignificant portion of the surface of the lips.

As seen in FIG. 3, the set of lips 12 with a central aperture 16 are provided with fissures or channels 17. The plastic sheet 18 is secured, after pre-filling the cavity formed therewith with lip gloss, by securing (heat seal or adhesive, for example) the same to the outer perimeter 19 of the lips 12. Alternatively, a separate pouch, like a small two sided balloon, can be filled with lip gloss. It is provided with an exit hole and that exit hole is aligned with the hole 16 of the lips 12 or a very short tube can extend from the pouch to hole 16 for purposes of allowing lip gloss to pass from reservoir, cavity or pouch to the hole 16 and then to the surface of the lips when and if the pouch or cavity of lip gloss is squeezed.

Whether a sheet of plastic 18 or a separate pouch for containing the lip gloss is provided, the reservoir for the lip gloss is located beneath the set of lips 12, and sits inside the container 10. The cavity or pouch serve to hold the lip gloss until desired for use. The reservoir 50 is either a pouch with an opening or has a tube aligned with the central hole 16 of the lips 12 or is formed by the rear, relatively flat surface of the lips and the thin plastic sheet 18, sealed to the outer rim as at 19, of the lips 12. In any event, it is desired that the lip gloss inside the reservoir not leak out except when the user desires an application or transfer of the lip gloss to her lips. The only desired end exit for lip gloss from the reservoir 50 or pouch or cavity is the small hole 16 in the lips 12.

Figure 5:
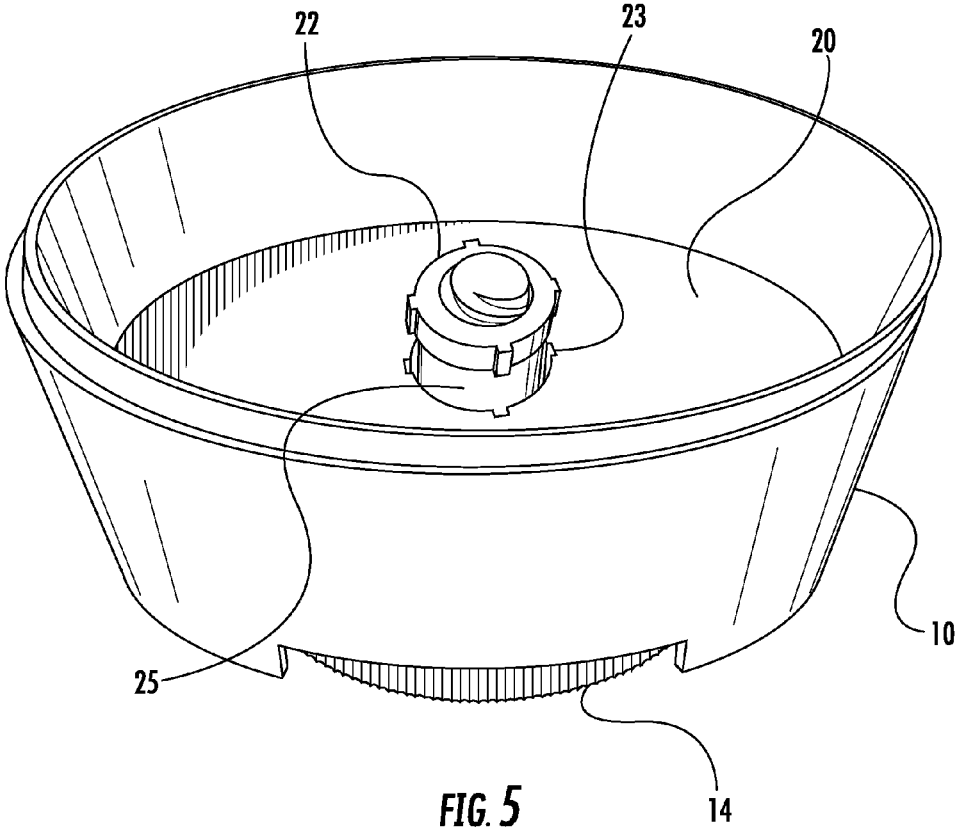
FIG. 5 is a top perspective view of the container portion of the present invention, with the lips and bladder removed and showing the central threaded post and the planar lift element thereon, within the confines of an oval container.
Figure 6A:
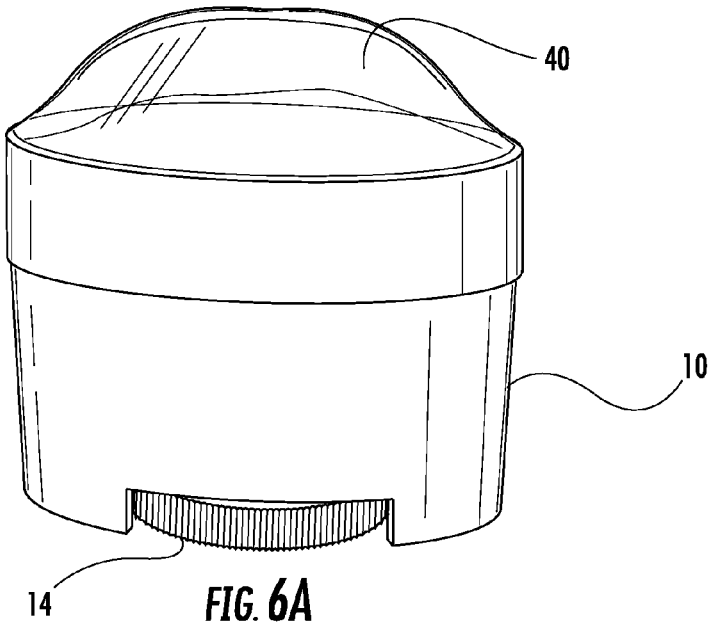
FIG. 6*a* is a front elevational view of the container and applicator for lip gloss with a cover thereon and FIG. 6*b* is a view of the container, open, with the artificial lips shown and the cap, also provided with artificial lips also shown adjacent to the container.
Figure 6B:
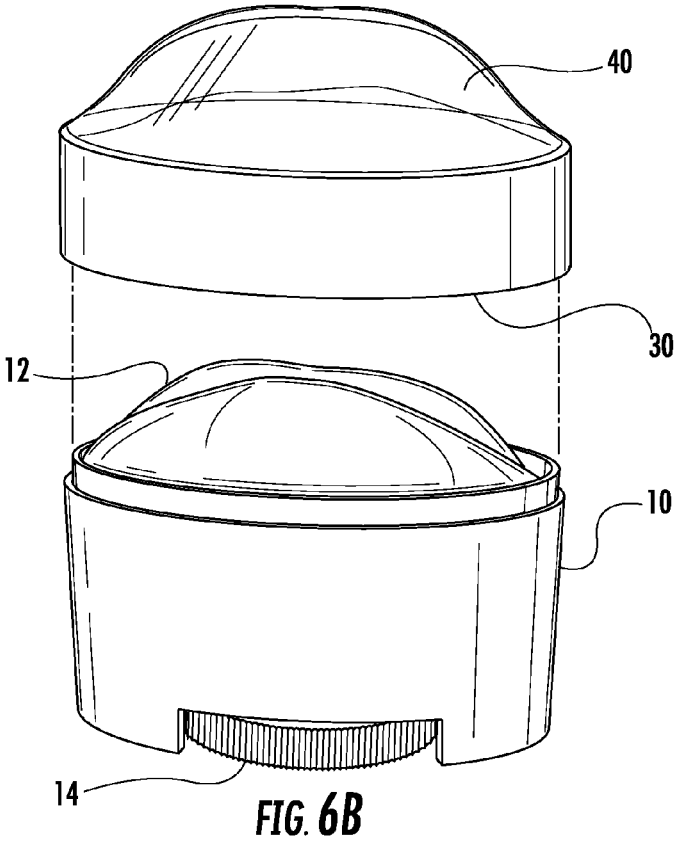

FIG. 5 is a perspective view of the container of the present invention, with the artificial lips 12 and pouch or cavity/reservoir removed for ease of illustration and understanding. This shows the internal working components of the applicator 10. Inside the container portion and directly above the knob or turning mechanism 14, is an elevator-type lift, a planar surface 20 whose shape is preferably oval to match the internal contour of the oval-shaped container. The lift or planar surface 20 is provided with a central threaded hole 23 and bolt 22 which mate with the outer threads of the central post 25. The central post 25 is provided with external screw threads and is fixed to the center of the turning knob 14 so that rotation of the turning knob in a first direction (say clockwise as viewed from above) will cause the center post to likewise turn clockwise. Since the planar lift surface 20 is threaded to the central post 25 and rotational movement of the planar lift surface 20 is constricted by the inner wall of the container, the planar surface can not rotate but, rather, it will move upwardly or downwardly, depending upon the direction of turning the knob. In the preferred embodiment, rotation of the knob 14 in a clockwise direction will cause the post to rotate clockwise which will cause the flat planar surface to move upwardly whereas a rotation of the knob 14 in the opposite or counter-clockwise direction will cause the attached post to similarly move counter-clockwise which will cause the flat planar lift surface 20 to move downwardly. When a user turns the knob or turning mechanism 14 in the desired direction, the flat planar lift surface 20—inside the container 10, raises up as the post rotates. The contact of the top of the flat planar lift surface 20 with the base or bottom of the reservoir or the thin sheet of plastic 18 will cause the reservoir to be squeezed between the planar lift surface 20 and the bottom surface of the lips 12. This will force some of the lip gloss inside the reservoir 50 or cavity through its exit or through the small hole 16 in the artificial lips 12, and the viscosity and micro-fissures and channels 17 of the artificial lips 12 cause the lip gloss to quickly and evenly spread over the surface of the lips 12. A user can then, easily and without mess, apply or transfer the lip gloss to her own lips by kissing her own lips to the set of artificial lips 12 on the device. That will result in a transfer of the lip gloss from the surface of the artificial lips to the user's actual lips. A user can continue to extract lip gloss from the reservoir 50 by continuing to turn the knob resulting in a raising of the planar lift surface, until there is no more lip gloss remaining in the reservoir. Of course, as desired and when the transfer of lip gloss to the user's lips is complete, the knob can be turned in the other direction so as to cause the planar lift surface to move downwardly, removing the squeezing pressure on the reservoir and ceasing the oozing of lip gloss out of the pouch or cavity.

A cap 30 is provided to cover the container 10 and the artificial lips 12, in a conventional manner, e.g., similar to a cap used for small or travel size under arm deodorant. In a preferred embodiment of the present invention, the top surface of the cap 30 can itself be provided with a second set of artificial lips 40 which are either of similar material and texture to that within the cap or the second set can be of hard plastic.

What is claimed:

1. A lip gloss applicator and quantity of lip gloss contained therein, comprising:

a one hand-holdable container with a reservoir volume for containing said quantity of said lip gloss;

a mold secured to said container and comprising a realistic shaped set of human lips, said mold having a contact and lip gloss transfer surface;

said reservoir being in fluid connection with said contact and lip gloss transfer surface for said set of human lips; and a dispensing means mechanically connected to said reservoir which, when activated, causes a volume of said lip gloss to be transferred from said reservoir to said contact and lip gloss transfer surface of said realistic shaped set of human lips.

2. A lip gloss applicator as claimed in claim 1 wherein said realistic shaped set of human lips are soft and resilient.

3. A lip gloss applicator as claimed in claim 1 wherein said contact and lip gloss transfer surface of said realistic shaped set of human lips is provided with one or more channels for facilitating the spreading of said lip gloss onto said contact and lip gloss transfer surface.

4. A lip gloss applicator as claimed in claim 1 wherein said dispensing means comprises a turning knob, a threaded post fixedly connected thereto and a threaded planar lift on said post which is confined from relative rotation by a mating shape of the interior shape of said container, said reservoir held between said realistic shaped set of human lips and said planar lift, such that turning said knob causes said planar lift surface to raise and thereby squeeze said reservoir to dispense said lip gloss to said contact and lip gloss transfer surface.

5. A lip gloss applicator as claimed in claim 1 wherein said reservoir is a cavity formed by the bottom surface of said realistic and shaped human lips and a thin sheet of plastic secured to an outside edge of said realistic and shaped human lips.

6. A lip gloss applicator as claimed in claim 1 wherein said realistic shaped set of human lips are provided with channels for facilitating the spread of said lip gloss as the same is forced out of said reservoir and onto said contact and lip gloss transfer surface of said realistic shaped set of human lips.

7. A lip gloss applicator as claimed in claim 1 wherein said reservoir comprises a pouch of said quantity of lip gloss located beneath said realistic shape set of human lips and said pouch is provided with an exit opening which terminates proximal to the contact and lip gloss transfer surface of said realistic shaped set of human lips.

8. A lip gloss applicator as claimed in claim 1 wherein said container is provided with a protective cap also in the shape of a realistic shaped set of human lips.

9. A lip gloss applicator as claimed in claim 1, wherein said realistic shaped set of human lips are molded from the actual lips of a person.

10. A lip gloss applicator as claimed in claim 1, wherein said realistic shaped set of human lips are made of soft rubbery-like material and are textured and resilient to resemble an actual set of human lips.

11. A lip gloss applicator as claimed in claim 1 wherein said realistic shaped set of human lips are three dimensional and further comprise small fissures on the lip gloss and contact surface.

* * * * *